United States Patent [19]

Bealmear

[11] 4,061,409

[45] Dec. 6, 1977

[54] RELEASABLE LOCKING MEANS FOR TWO PART ELECTRIC CONNECTOR

[76] Inventor: Herbert Shipley Bealmear, Ridge Road, Box 8C, Hanover, Md. 21076

[21] Appl. No.: 740,560

[22] Filed: Nov. 10, 1976

[51] Int. Cl.[2] ..... H01R 13/54

[52] U.S. Cl. ..... 339/75 P; 339/91 R

[58] Field of Search ..... 339/75 P, 91 R, 76, 339/148, 36-40, 195 R, 196 A, 74 R, 45 R

[56] References Cited

U.S. PATENT DOCUMENTS

| | | | |
|---|---|---|---|
| 1,694,056 | 12/1928 | Calkins | 339/76 |
| 2,704,831 | 3/1955 | Smith | 339/75 P X |
| 2,732,531 | 1/1956 | Janowiec | 339/75 P |
| 3,942,856 | 3/1976 | Mindheim | 339/36 X |

*Primary Examiner*—Joseph H. McGlynn
*Assistant Examiner*—E. F. Desmond
*Attorney, Agent, or Firm*—J. Wesley Everett

[57] ABSTRACT

A releasable locking means for a two part electrical connector member for preventing the accidental separation of the two body members when they are joined in electrical engagement where one body member is provided with at least two male circuit-carrying elements, one male element carrying high potential electrical current and the other male element carrying low potential electrical current, both elements extending outwardly from the face of one of the body members and aligned with corresponding individual recesses in the face of the second, or female, body member, which recesses are for receiving the two male circuit-carrying elements, the releasable locking member being in the form of a pin extending inwardly of the female body member and adapted to engage one of the extensions of the male body member when in one position and to disengage itself from the extended male element when in another position.

1 Claim, 6 Drawing Figures

RELEASABLE LOCKING MEANS FOR TWO PART ELECTRIC CONNECTOR

The present invention relates to an electrical connector made up of two separate body members having a locking means for preventing accidental separation when in assembled position.

One object of the invention is to provide a simple locking arrangement that will releasably hold the body members in engagement when desired.

Another object of the invention is to provide a structure for the locking device which will prevent any electric shock to the user.

While several objects of the invention have been set forth, other objects, uses and advantages will become apparent as the nature of the invention is more fully disclosed in the following detailed description with reference to the accompanying drawings, in which.

In referring to the drawings, like and similar reference characters are used to designate like and similar parts throughout the several views.

Figure 1:
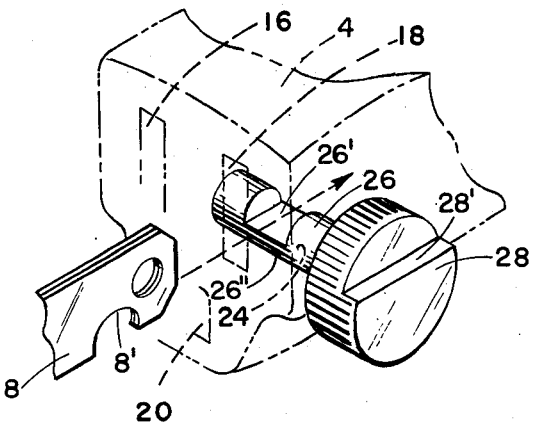
FIG. 1 is a phantom view in perspective showing the locking element in unlocked position.

The connector is primarily for use with a portable cord such as an extension cord, but is not limited thereto.

The connector unit comprises two parts, a male member 2 and a female member 4. The male member 2 is provided with a high potential electric element 10, a low potential element 8 and a ground 12. These elements lead to corresponding wires carried within the cord 14.

The low potential element 8 is provided with a recess or cut-away portion 8′ to be later referred to.

The female member 4 is provided with recesses 16, 18 and 20 which contain connector elements such as metal friction engaging means leading to corresponding wires within the cord 22 for conveying the current therethrough.

Extending inwardly from one side of the female member 4 and perpendicular to the plane of at least one of the extended contact members is an aperture 24. Slideable into this aperture 24 is a pin 26 having a knob 28 for operating the pin. While the pin may have various ways of engaging the slot 8′ of the element 8, such as a push and pull operation, the preferred form shows the pin 26 being rotatable by the knob 28 as shown best in FIGS. 1 and 2. The pin 26 is provided with a cut-away portion 26′ which will allow the member 8 to by-pass the pin when the pin is rotated so that the bottom of the slot 26′ is below the plane of the adjacent side of the extended member 8.

When the two members 2 and 4 are in complete assembly, that is, face to face, the notch 8′ and the element 8 will coincide with the aperture 24 carrying the pin 26.

In order to know the position of the slot 26′ within the member 4, a telltale is placed on the knob 28, such as the cut-away portion 28′.

Figure 3:
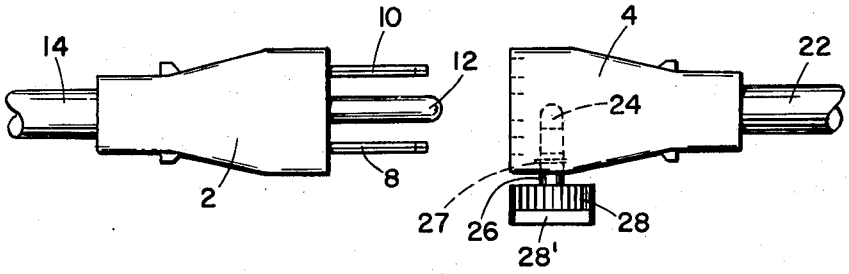
FIG. 3 is a top plan view showing the two body members in position for engagement.
Figure 4:
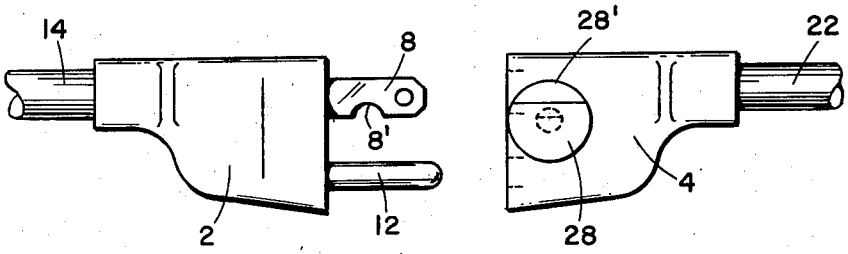
FIG. 4 is a side elevational view of the two body members in a position similar to that shown in FIG. 3.

The aperture 24 is of such depth and the pin is of such length and so located within the female member as to extend only a short distance beyond the projected element 8, such as shown in FIG. 3.

While the pin 26 is preferably adapted to engage the element 8, which is the low potential side of the electric circuit, the pin may be located to engage the ground extension 12 (not shown); or, if the pin 26 is made of a non-conductive material, such as plastic, it may operate in connection with the extension 10 carrying the high potential current. The pin may be made of any suitable material and is preferably made to engage the low side of the electric circuit for safety reasons.

In order to retain the pin 26 in a position relative to the member 4 there is a conventional type ring 27 positioned on the pin 26 operating within a suitable groove which will allow the pin to be rotated in place within the aperture 24.

Figure 2:
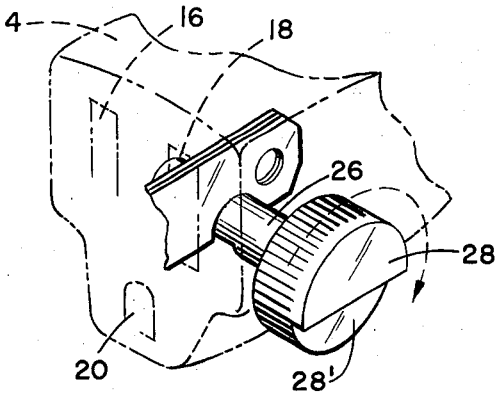
FIG. 2 is a phantom view in perspective showing the locking arrangement in locked position.
Figure 5:
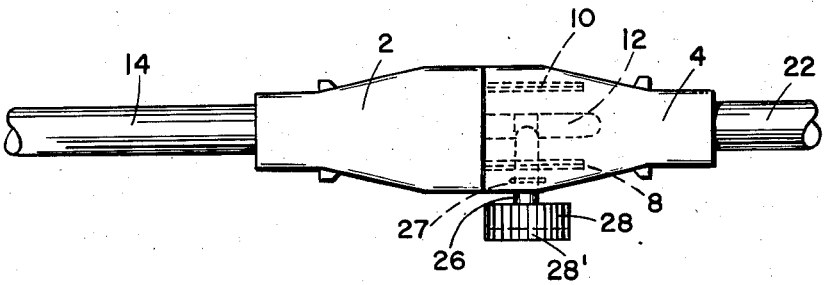
FIG. 5 is a top plan view of the two connector body members in assembled locked position.
Figure 6:
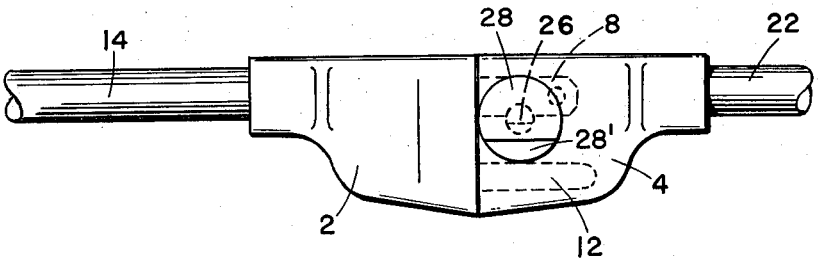
FIG. 6 is a side elevational view of the same.

In operation, the knob 28 is turned to the position as shown in FIG. 1 wherein the cut-away portion 26′ is opposite the cut-away portion 8′ in the contact member 8. The two members 2 and 4 are the pressed tightly together, as shown in FIGS. 5 and 6. At this point the knob 28 is operated to position the cut-away portion 26′ away from the contact member 8, as shown in FIG. 1. When the faces of the two members 2 and 4 are pressed into contact as shown in FIGS. 5 and 6, the pin 26 is rotated substantially 180° whereby the side 26″ of the pin opposite the cut-away portion will move into the recess 8′ locking the member 8 in position thereby preventing the accidental separation of the two body members 2 and 4. When it is desired to separate the two members 2 and 4, the knob 28 is again rotated another 180° causing the cut-away portion 26′ of the pin 26 to line up with the member 8 whereby the members 2 and 4 are easily disengaged.

While the invention is shown in a particular form, it is not intended as a limitation as this general idea of having a pin engaging one of the male extension elements may be employed in a number of ways.

I claim:

1. An electric connector of two separate body members with matching end faces, one of said members having a plurality of electric carrying elements extending outwardly from the matching face thereof, and the other body member having a plurality of recesses extending inwardly from the matching face of the second body member for receiving the extensions of the first body member, a cut-away portion formed in at least one of the extended elements for engaging a locking means carried by the second body member, the locking means comprising a rotatable locking pin mounted in an aperture in the second body member, said pin having a cut-away portion within at least one side thereof to allow the extended element carried by the lock engaging pin to pass through the cut-away portion of the pin when in one position and to engage the pin when the pin is rotated to another position.

* * * * *